US006475079B1

(12) United States Patent
Basey

(10) Patent No.: US 6,475,079 B1
(45) Date of Patent: Nov. 5, 2002

(54) METHOD AND APPARATUS FOR AN AIR VENT ASSEMBLY

(75) Inventor: Gary Basey, Portland, OR (US)

(73) Assignee: InFocus Corporation, Wilsonville, OR (US)

( * ) Notice: Subject to any disclaimer, the term of this patent is extended or adjusted under 35 U.S.C. 154(b) by 0 days.

(21) Appl. No.: 09/976,612

(22) Filed: Oct. 12, 2001

(51) Int. Cl.[7] ..... F24F 7/00
(52) U.S. Cl. ..... 454/309; 454/905
(58) Field of Search ..... 454/277, 293, 454/294, 295, 281, 309, 905

(56) References Cited

U.S. PATENT DOCUMENTS 4,688,767 A * 8/1987 Bradshaw ..... 256/19
5,133,692 A * 7/1992 Koop ..... 454/282
5,839,244 A * 11/1998 Johnson et al. ..... 454/224

* cited by examiner

*Primary Examiner*—Derek Boles
(74) *Attorney, Agent, or Firm*—Blakely Sokoloff Taylor & Zafman LLP

(57) ABSTRACT

A method and apparatus for an air vent assembly is provided in which individual louvers and spacers are connected together to form chevron shaped channels that allow increased air flow while blocking the escape of direct light. The louvers are formed into a chevron shape that extends lengthwise from one end of the louver to another end of the louver. The spacers are chevron shaped and interlock or are bonded together with one another to secure the louvers and to provide a support structure such that additional spacers and louvers may be stacked together as needed to form an air vent for use in a given device.

27 Claims, 13 Drawing Sheets

METHOD AND APPARATUS FOR AN AIR VENT ASSEMBLY

BACKGROUND OF THE INVENTION

1. Field of the Invention

The present invention relates generally to air vents for ventilating a device having a light source. More specifically, the present invention relates to an air vent assembly that blocks direct light without substantially restricting the flow of air through the vent.

2. Background Information

Devices requiring a light source for generating light, such as a projection display apparatus, an arc lamp, a laser device and the like, need to be ventilated to dissipate heat generated by the light while minimizing or preventing the escape of direct light emitted by the device. These types of devices are therefore typically equipped with an air vent.

The air vent permits the exchange of warm air from the interior of the device for cooler air exterior to the device. Projection display apparatuses in particular are often further equipped with fans to increase the airflow to accelerate the exchange of air. Thus, it is important to provide air vents that do not restrict or impede the flow of air from the interior to the exterior of the device to allow for maximum ventilation. As projection display apparatuses and the like get smaller and more sophisticated, it is also important to provide highly scalable air vents that are adaptable to a wide range of devices. The air vents should be easy to manufacture and lightweight enough to complement small, lightweight devices.

Prior art air vents are typically molded from a single tooled part. Consequently, prior art air vents are not only expensive to manufacture, but also difficult to redesign for use in new devices that may require larger, smaller, or differently shaped air vents. Retooling machinery to manufacture a redesigned air vent can also be expensive, requiring development resources and even new machinery.

Moreover, the manufacture of air vents from a single tooled part imposes certain limitations on the thickness of the individual louvers of the air vent as well as the distance between adjacent louvers. The thickness of the louvers and the distance between them dictate to a great degree the amount of air that flows through a vent. Prior art louvers with a greater thickness do not minimize airflow and, generally, do not minimize weight. For example a louver with a thickness of 5 millimeters (mm) will weigh more than a louver with a thickness of 3 mm made of the same material and having the same length and width. While some prior art air vents may be constructed out of thinner material such as sheet metal, those vents are typically simple single-vaned structures that are not capable of maximizing airflow and light blockage as is needed in devices having a light source for generating light, such as a projection display apparatus, an arc lamp, or a laser device.

Hence, what is needed is an air vent assembly that is scalable, easily adapted to a wide assortment of devices, and that maximizes airflow and light blockage.

SUMMARY

A method and apparatus for an air vent assembly is provided in which individual louvers and spacers are connected together to form chevron shaped channels that allow increased air flow while blocking the escape of direct light. According to one aspect of the invention, the louvers are formed into a chevron shape that extends lengthwise from one end of the louver to another end of the louver. According to another aspect of the invention, the spacers are chevron shaped and interlock or are bonded with one another to secure the louvers and to provide a support structure such that additional spacers and louvers may be stacked together as needed to form an air vent for use in a given device.

According to one aspect of the invention, numerous variations in the length, width, and thickness of the louvers and corresponding variations in the size of the spacers may be employed to quickly assemble an optimal air vent for a number of different devices, including presentation projectors, arc lamps, laser devices and the like, thereby eliminating the need for extensive redesign of an air vent when a new device requiring ventilation is developed.

BRIEF DESCRIPTION OF DRAWINGS

The present invention will be described by way of exemplary embodiments, but not limitations, illustrated in the accompanying drawings in which like references denote similar elements, and in which.

DETAILED DESCRIPTION OF THE INVENTION

In the following description, various aspects of the present invention, a method and apparatus for an air vent assembly, will be described. Specific details will be set forth in order to provide a thorough understanding of the present invention. However, it will be apparent to those skilled in the art that the present invention may be practiced with only some or all of the described aspects of the present invention, and with or without some or all of the specific details. In some instances, well-known features may be omitted or simplified in order not to obscure the present invention.

Various operations will be described as multiple discrete steps performed in turn in a manner that is most helpful in understanding the present invention. However, the order of description should not be construed as to imply that these operations are necessarily performed in the order they are presented, or even order dependent. Lastly, repeated usage of the phrase "in one embodiment" does not necessarily refer to the same embodiment, although it may.

The present invention provides a method and apparatus for assembling an air vent apparatus for blocking light such as the air vent described in co-pending U.S. patent application Ser. No. 09/607,572, "Air Vent Apparatus for Blocking Light," assigned to InFocus Corporation of Wilsonville, Oreg., the assignee of the present invention. The air vent assembly is comprised of louvers having angled vanes coupled together with interlocking spacers so as to maximize air flow and light blockage through the air vent. The louver and spacer assembly provides a lightweight air vent that substantially minimizes the amount of tooling required to manufacture the air vent. Because the air vent is assembled rather than manufactured as a single tooled part, the air vent is relatively inexpensive to make and is easily scaled to size to suit the needs of the device in which it is used. Moreover the louvers and spacers may be constructed from a variety of thin, lightweight materials, again to suit the needs of the device in which it is used.

Figure 1:
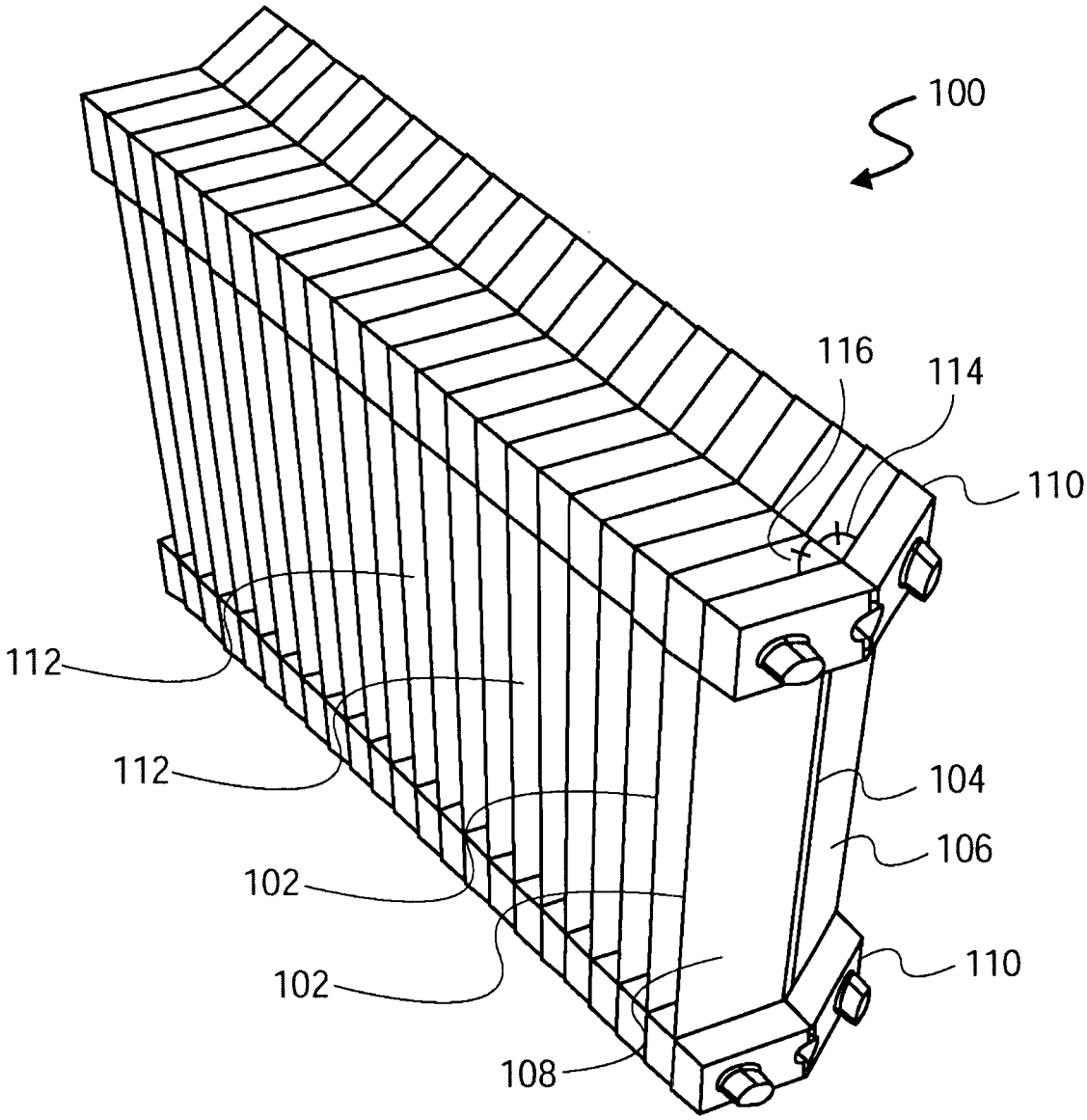
FIG. 1 illustrates a perspective view of an air vent assembly in accordance with one embodiment of the present invention.

FIG. 1 illustrates a perspective view of an air vent assembly in accordance with one embodiment of the present invention. The air vent assembly 100 is comprised of one or more louvers 102 separated by interlocking spacers 110. In one embodiment, the louvers 102 are flexed lengthwise at an intermediate location 104 that runs the full length of the louver 102 to deform the louver 102 into a chevron shape having two vanes 106 and 108 extending at angles 114 and 116 on either side of the intermediary location 104. The chevron shape is repeated in the shape of the interlocking spacer 110 so that the louvers 102 and interlocking spacers 110, when assembled together, form parallel sets of angled channels 112 through which air may flow but light is blocked. Although the intermediary location 104 and vanes 106 and 108 are illustrated as symmetrically disposed around the center of the louver 102, other variations in the intermediary location 104 and vanes 106 and 108 may be employed such that the vanes 106 and 108 are disposed asymmetrically at an intermediary location 104 that is located to the left or right of the center of the louver 102 without departing from the scope of the invention. Moreover, the angles 114 and 116 of the vanes 106 and 108 disposed around the intermediary location 104 and the resulting chevron shape of the louver 102 and spacer 110 may be varied depending on the air flow and light blockage requirements of the device for which the air vent 100 is assembled.

Figure 2:
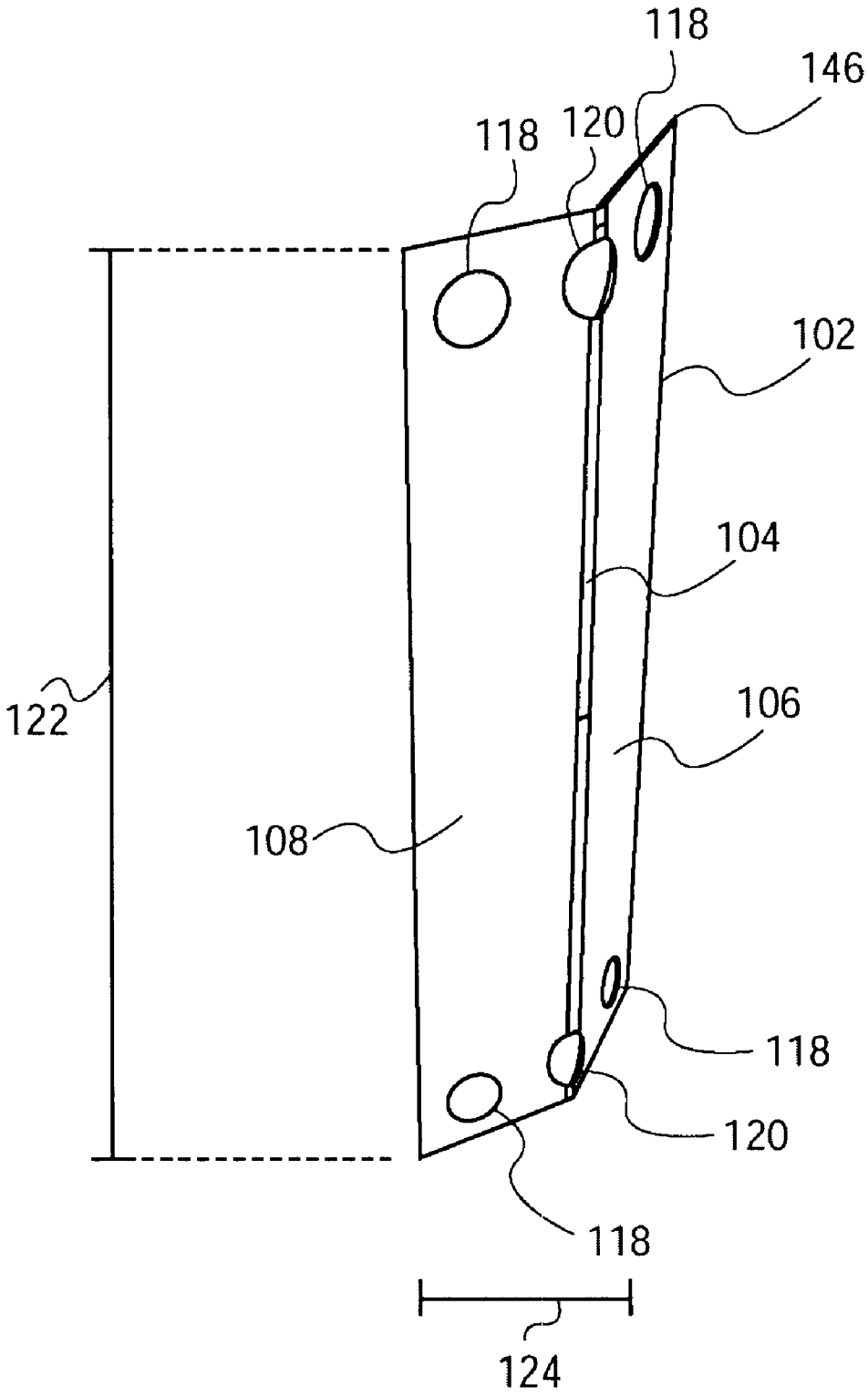
FIG. 2 illustrates a single louver of the air vent assembly illustrated in FIG. 1, in accordance with one embodiment of the present invention.

FIG. 2 illustrates a single louver 102 of the air vent assembly 100 illustrated in FIG. 1, in accordance with one embodiment of the present invention. In one embodiment, the louver 102 is a rectangular shape having a length 122 and a width 124, and is constructed of a strong thin material having a certain thickness 146 such as a sheet stock of a thin substrate such as Nomex or other thin thermoplastic material. Alternatively, the louver 102 may be constructed from a material such as a polycarbonate. The material from which the louver 102 is constructed is preferably non-conductive, but the louver 102 could also be constructed from a thin metal sheet if conductivity of electric current in the device is not a concern. The material from which the louver 102 is constructed may also be dark or opaque to aid in blocking the escape of light, and preferably has a relatively high flammability rating to safely withstand the heat generated by the light source of the device for which the air vent assembly 100 is intended. As noted in the description for FIG. 1, the louver 102 is flexed lengthwise at an intermediary location 104 that runs the full length 124 of the louver 102 to deform the louver 102 into a chevron shape having two vanes 106 and 108 on either side of the intermediary location 104. In an alternate embodiment, the louver 102 may be constructed from material that is already fixed into the chevron shape having the two vanes 106 and 108 on either side of the intermediate location 104, or possibly from material having a flexible spine at the intermediate location 104 that permits variations in the angles 114 and 116 of the two vanes 106 and 108 that extend from the spine, or even from two separate pieces of material joined together at the intermediate location 104 to create angles 114 and 116 of the two vanes 106 and 108. The thickness 146 of the material from which the louver 102 is constructed together with the size of the angles 114 and 116 formed when flexing the louver 102 are calibrated so that there is a maximum amount of airflow through the parallel sets of angled channels 112 of the assembled air vent 100 while at the same time blocking the escape of light. Numerous other variations in the types of material used to construct the louver may be employed without departing from the scope of the invention.

In one embodiment, the louver 102 has one or more anchoring openings 118 through which to locate and anchor the louver 102 to one of the interlocking spacers 110 as described more fully in FIGS. 3A–3B below. At intermittent locations or at the end of the louver 102 as shown, disposed between the anchoring openings 118, is a tooling opening 120 through which the louvers 102 and spacers 110 may be located and anchored together to an assembly mechanism to ease the alignment of the louvers 102 and spacers 110 to facilitate the assembly of the air vent 100 as described more fully in FIG. 5 below. In one embodiment, the louver may be of sufficient length that anchoring openings 118 and tooling openings 120 are provided not just at the corners and ends of the louver as shown, but also at intermediary points along the length of the louver.

Figure 3A:
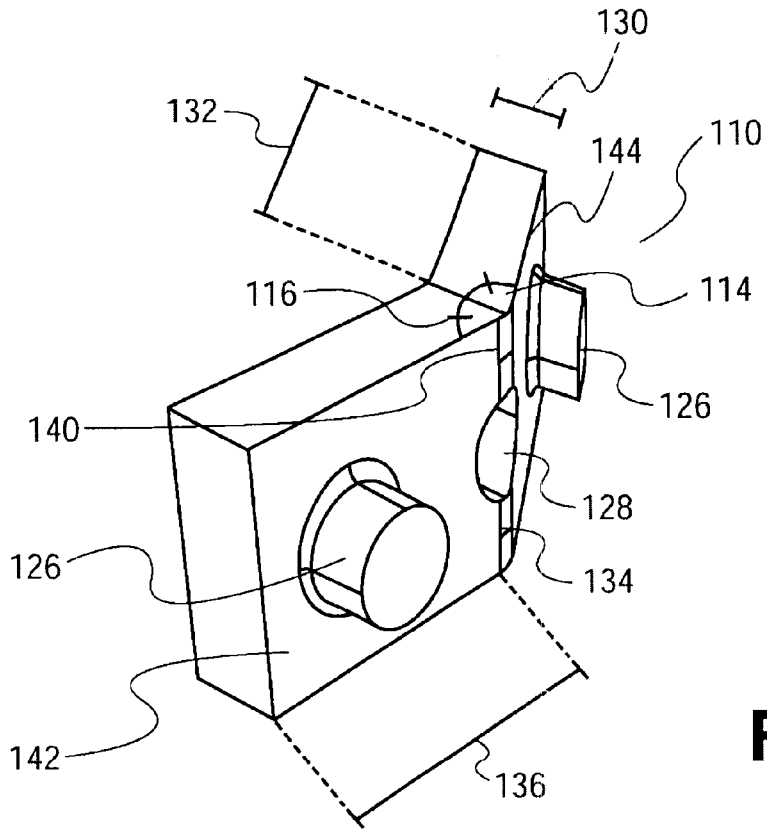
FIG. 3A illustrates a front perspective view of a single spacer of the air vent assembly illustrated in FIG.1, in accordance with one embodiment of the present invention.
Figure 3B:
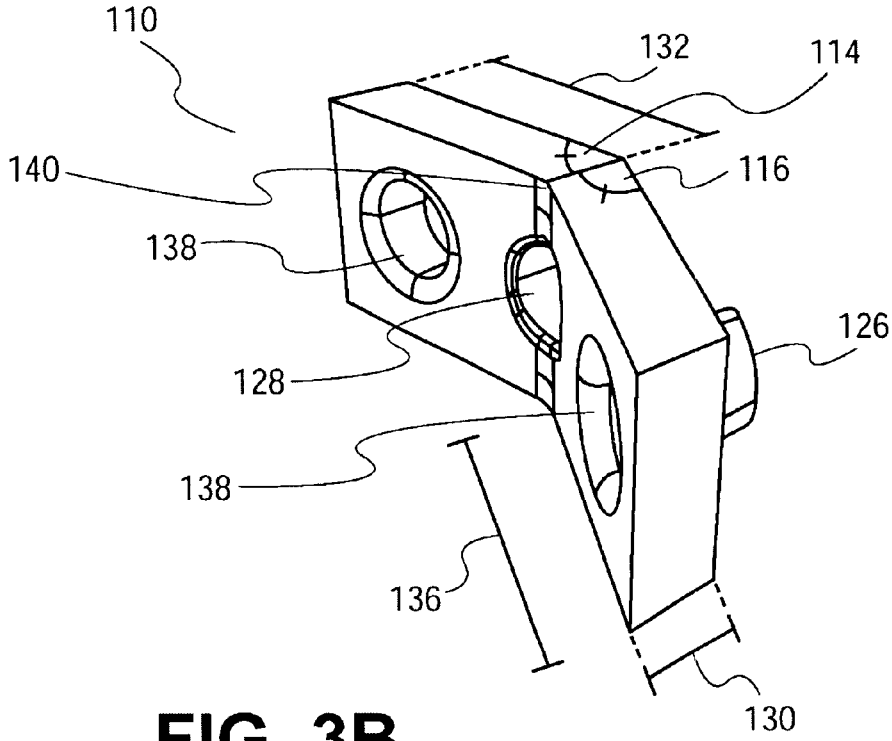
FIG. 3B illustrates a rear perspective view of a single spacer of the air vent assembly illustrated in FIG.1, in accordance with one embodiment of the present invention.

FIGS. 3A and 3B illustrate a front and rear perspective view respectively of a single spacer 110 of the air vent assembly 100 illustrated in FIG. 1, in accordance with one embodiment of the present invention. The spacer 110 is formed from a material such as polycarbonate into a chevron shape that corresponds to the shape of a flexed louver, the spacer 110 having two vanes 142 and 144 on either side of an intermediary location 140, each vane having a width 132 and 136 that correspond to the total width 124 of the vanes of the louver 102, as well as a depth 130 that determines the spacing between two adjacent louvers 102 in the air vent assembly 100 to form the angled channels 112. Numerous other variations in the types of material used to construct the spacer 110 may be employed without departing from the scope of the invention as long as the material has a relatively high flammability rating to safely withstand the heat generated by the light source of the device for which the air vent assembly 100 is intended.

The vanes 142 and 144 each have a corresponding fixed angle 114 and 116 measured from the intermediary location 140 that, when assembled with the louvers 102, determines the corresponding angles 114 and 116 of the vanes 106 and 108 of the louver 102.

In one embodiment, the spacer is further provided on each vane 142 and 144 with a post 126 protruding from the front of the spacer and forming a corresponding hole 138 extending into the rear of the spacer. The post 126 and hole 138 function together as an interlocking mechanism as is known in the art where the post 126 fits snugly into the receiving hole 138 of an adjacent spacer 110 and facilitates stacking multiple spacers 110 together to form the air vent 100 as described more fully in FIG. 5. Although illustrated as a post 126 and hole 138 interlocking mechanism, other types of interlocking mechanisms that are known in the art may be employed, such as a tab and slot interlocking mechanism, without departing from the scope of the invention, as long as the interlocking mechanism permits the secure stacking of multiple spacers 110 and corresponding louvers 102. to form the air vent assembly 100.

Figure 5:
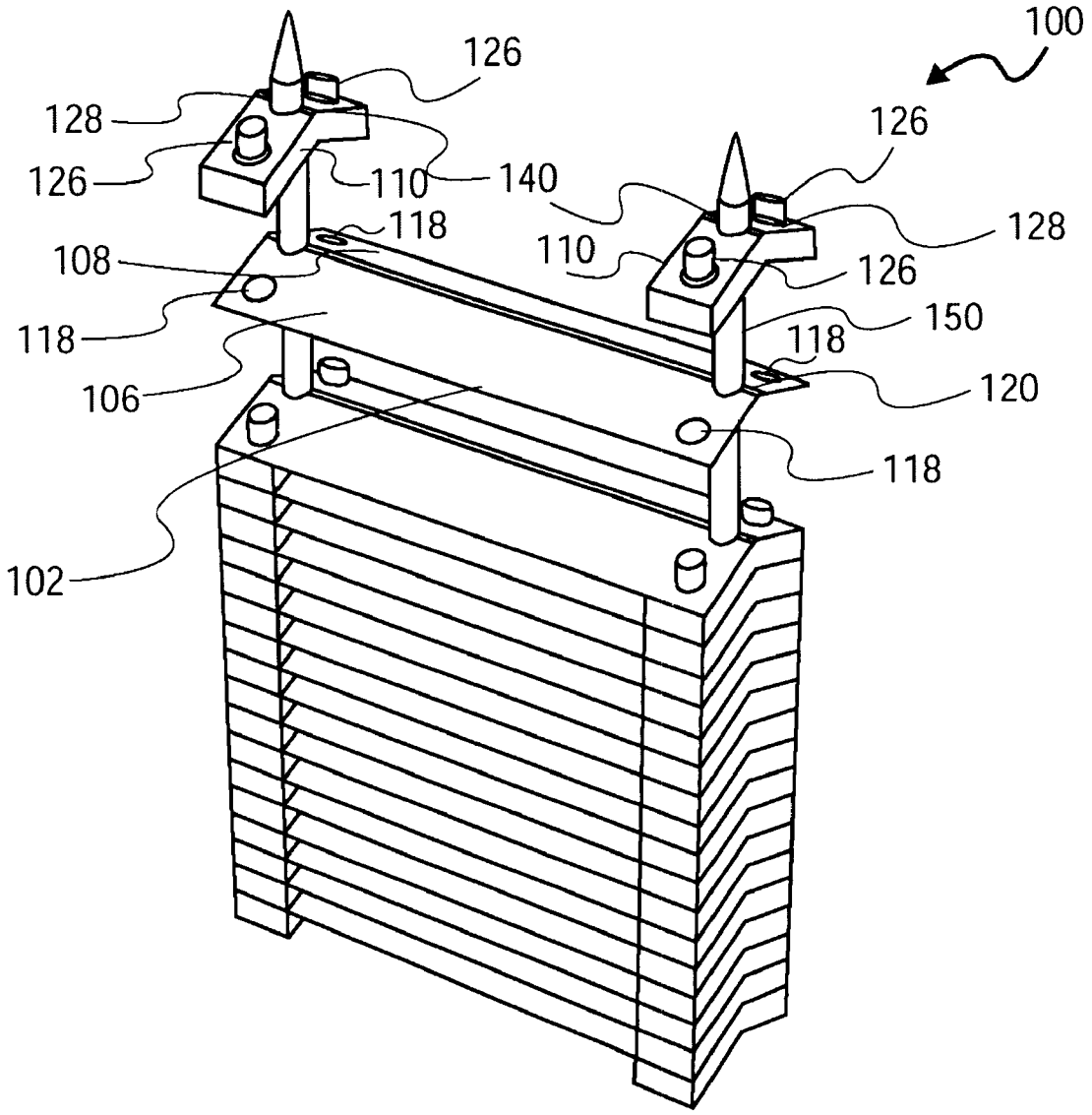
FIG. 5 illustrates an exploded view of the air vent assembly illustrated in FIG. 1, in accordance with one embodiment of the present invention.

In one embodiment, the spacer 110 is further provided with a tooling opening 128 that corresponds to the tooling opening 120 of the louver 102 to facilitate the assembly of the air vent 100 as described more fully in FIG. 5. In one embodiment, the tooling opening 128 is located at the intermediary location 140. Although the intermediary location 140 and vanes 142 and 144 are illustrated as symmetrically disposed around the center of the spacer 110, other variations in the intermediary location 140 and vanes 142 and 144 may be employed that are disposed asymmetrically to the left or right of the center of the spacer 110 without departing from the scope of the invention. Moreover, the angles 114 and 116 of the vanes 142 and 144 disposed around the intermediary location 140, and their corresponding widths 132 and 136 and depth 130 that determine the resulting chevron shape of the spacer 110 as well as the chevron shape of the assembled louvers 102 may be varied depending on the air flow and light blockage requirements of the device for which the air vent 100 is assembled.

Figure 4:
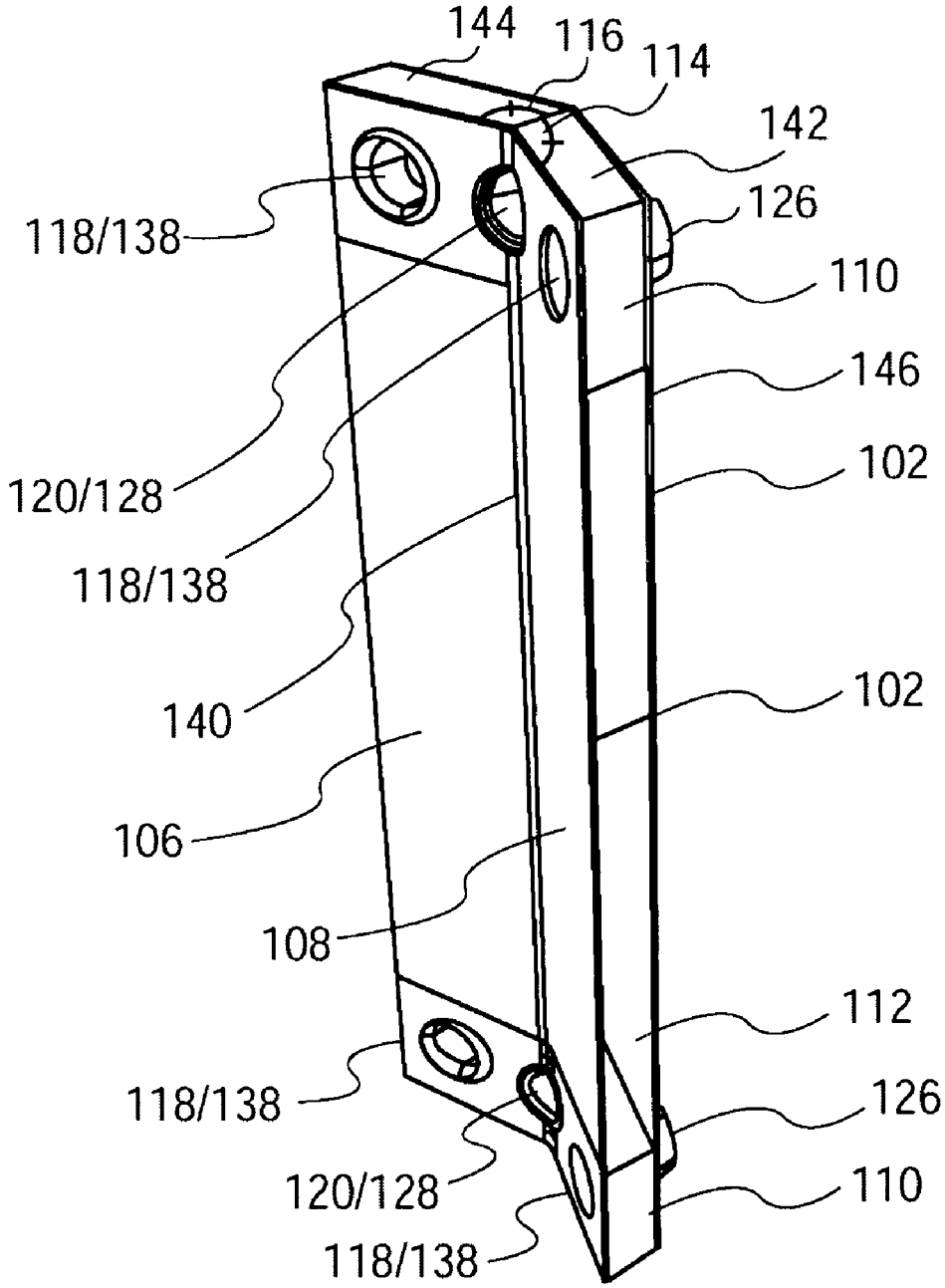
FIG. 4 illustrates a detailed rear view of two adjacent louvers of the air vent assembly illustrated in FIG. 1, separated by spacers in accordance with one embodiment of the present invention.

FIG. 4 illustrates a detailed rearview of two adjacent louvers 102 of the air vent assembly 100 illustrated in FIG. 1, separated by spacers 110 in accordance with one embodiment of the present invention. As shown, the louvers 102 are connected to the spacers 110 such that the anchoring openings 118 of the louvers 102 are anchored over the corresponding post 126 and aligned with the corresponding hole 138 of the spacer 110 to facilitate the assembly of the air vent 100. In one embodiment the tooling openings 120 and 128 of the louvers 102 and spacers 110, respectively, are aligned to further facilitate the assembly of the air vent 100. As previously indicated, in one embodiment, the louvers 102 may be of a length such that the anchoring 118 and tooling openings 120 are located intermittently along the length of the louver, thereby permitting the louvers 102 to be connected to multiple sets of spacers 110, and not just at the ends of the louvers 102 as illustrated.

FIG. 5 illustrates an exploded view of the air vent assembly 100 illustrated in FIG. 1, in accordance with one embodiment of the present invention. In the illustrated embodiment the air vent assembly 100 is assembled by interleaving together a louver 102 and two spacers 110 anchored to the louver 102 using an assembly mechanism such as a tooling rod 150 to insure that the layers of stacked louvers 102 and corresponding pairs of spacers 110 are properly aligned along the respective tooling openings 120 and 128. The resulting assemblage of louvers 102 flexed into a chevron shape that conforms to the chevron shape of the corresponding spacers 110 is further mounted in a device housing that encases the device for which the air vent 100 is assembled as described more fully with reference to FIGS. 9–11 below.

In one embodiment, the assembly process begins by threading a spacer 110 onto one or more tooling rods 150 through the spacer's tooling opening 128, followed by a chevron-shaped louver 102 through the louver's tooling opening 120. The louver 102 is anchored over the spacer 110 by placing the louver's anchoring openings 118 over the corresponding posts 128 of the spacers. The assembly of the threaded spacer 110 and louver 102 is secured by threading an adjacent spacer 110 onto the tooling rods 150 such that the holes 138 of the adjacent spacer 110 fit snugly over the corresponding posts 126 of the previously threaded spacer 110 protruding through the anchoring openings 118 of the previously threaded louver 102. This method of assembly locks the louver 102 in place between two spacers 110. The process is repeated until an air vent 100 is completely assembled. In one embodiment, the assembled louvers 102 and spacers 100 may be further secured using a bonding agent, such as glue, to strengthen the post 126 and hole 138 connection between adjacent spacers 110.

Figure 6:
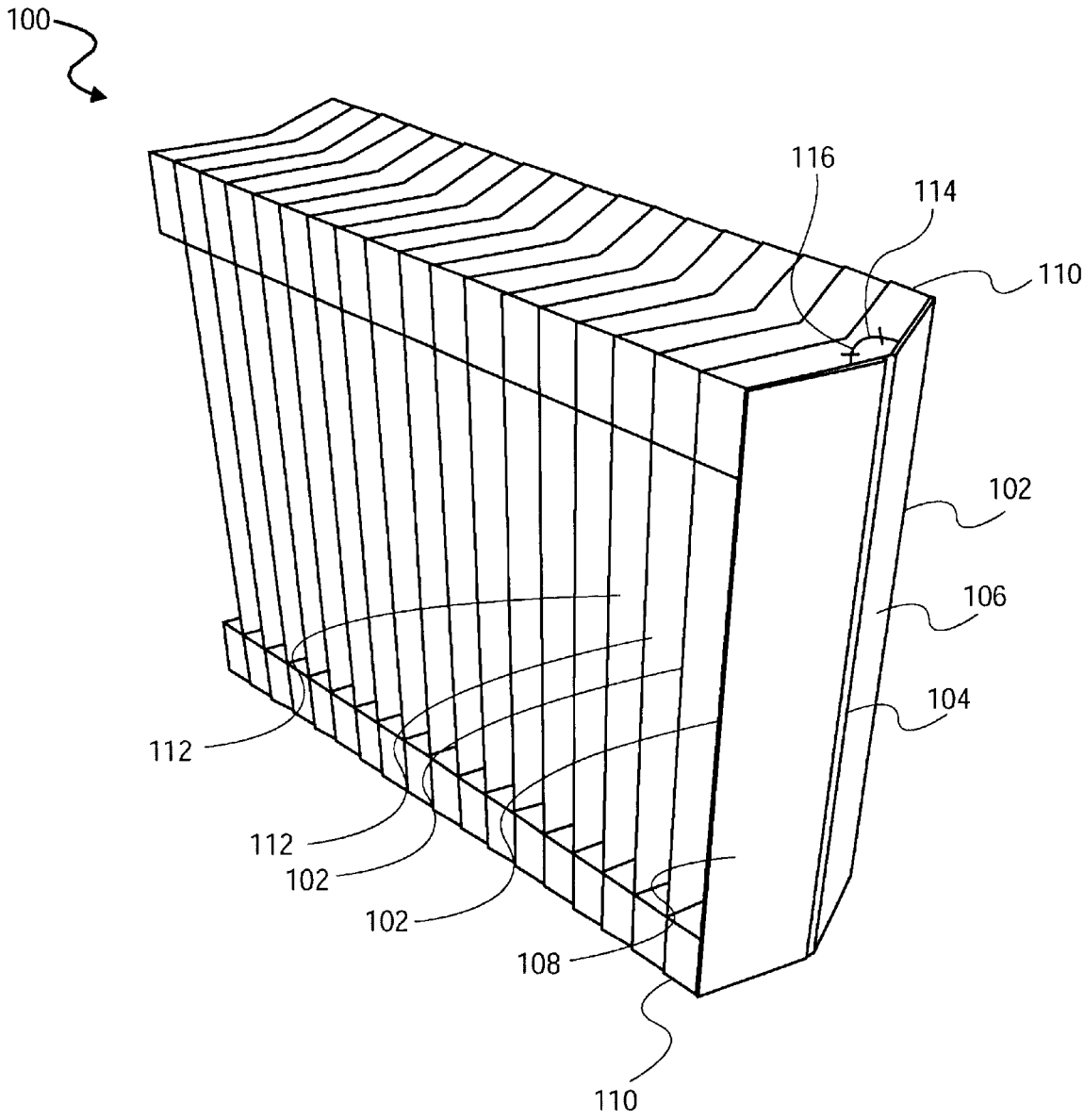
FIG. 6 illustrates a perspective view of an air vent assembly in accordance with one embodiment of the present invention.
Figure 7:
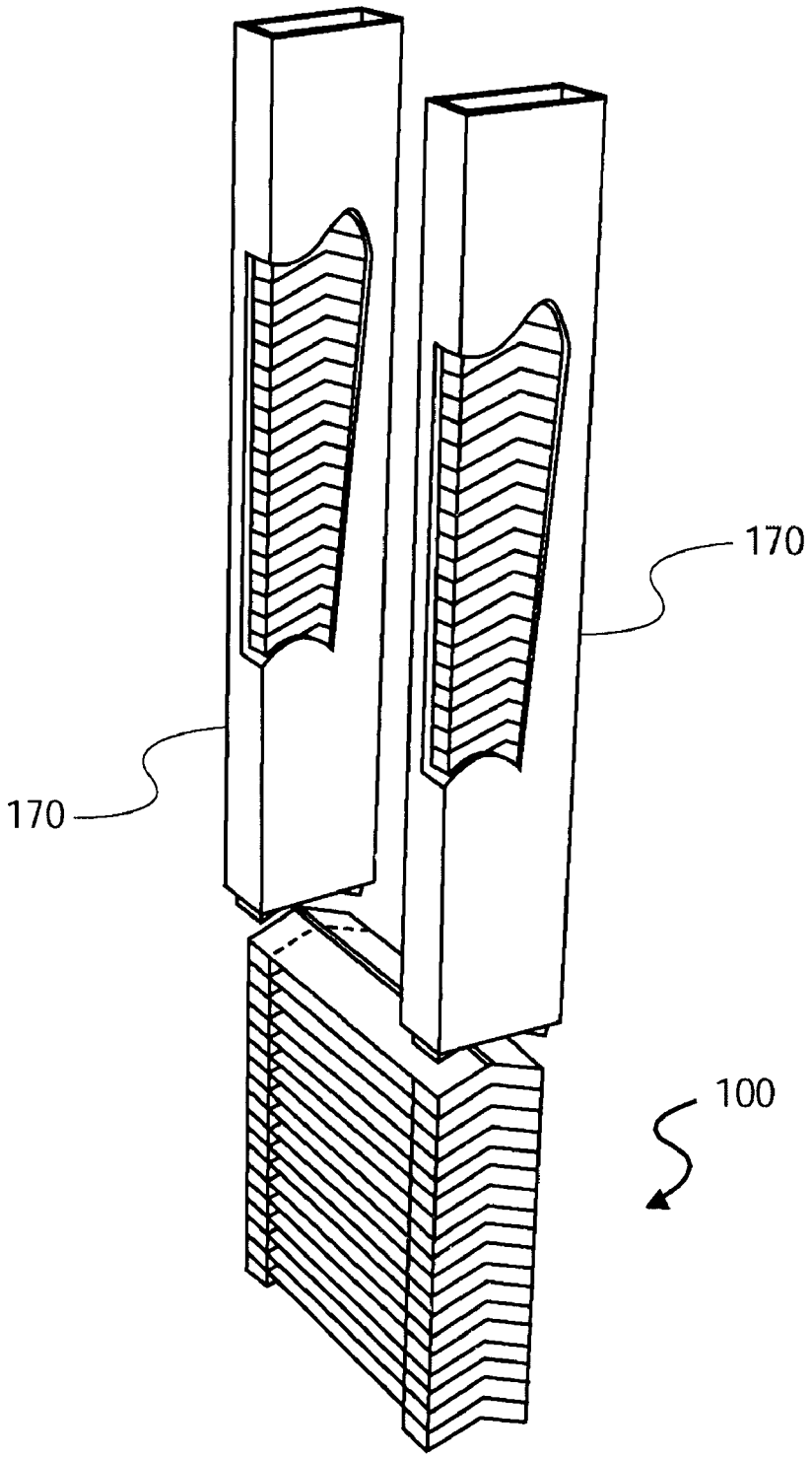
FIG. 7 illustrates a perspective view of an assembly mechanism in conjunction with an air vent assembly in accordance with one embodiment of the present invention.
Figure 8:
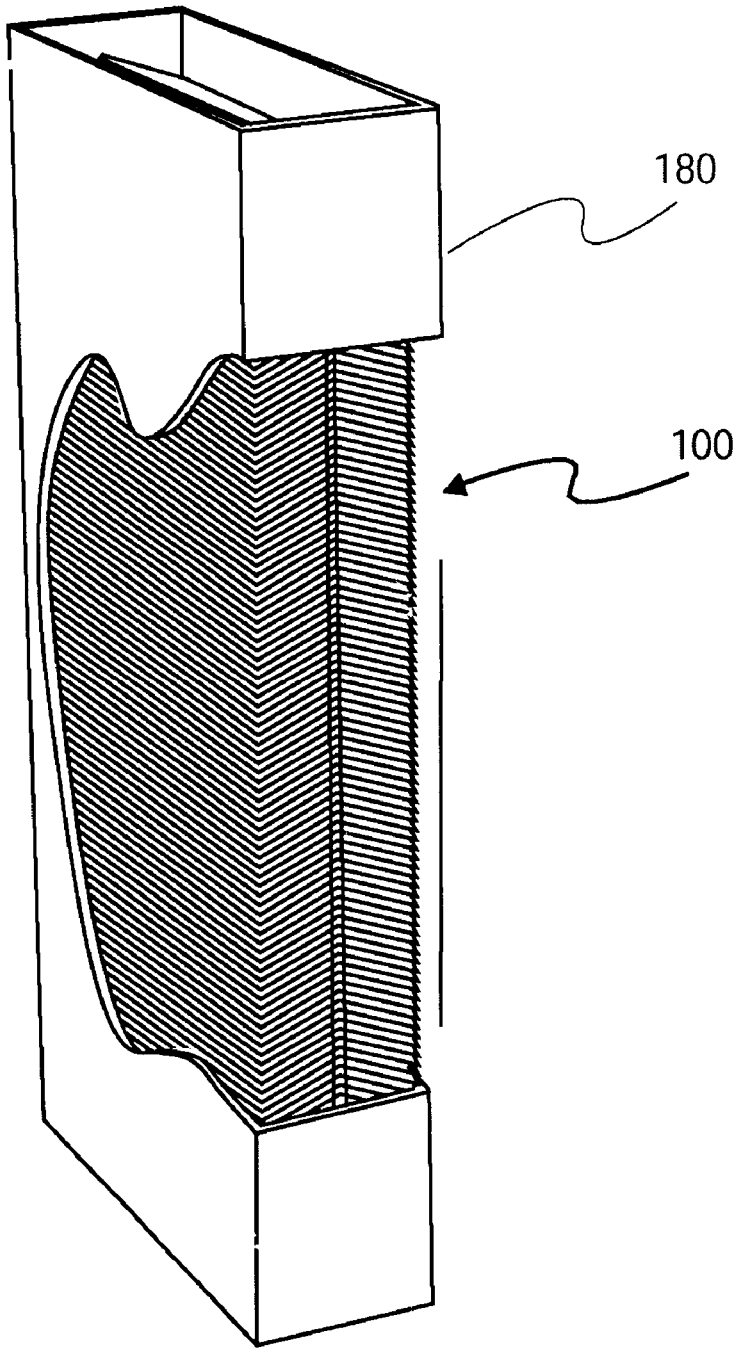
FIG. 8 illustrates a perspective view of another assembly mechanism in conjunction with an air vent assembly in accordance with one embodiment of the present invention.

Other aligning mechanisms other than a tooling rod 150 may be employed to assemble the air vent 100 without departing from the scope of the invention. For example, FIG. 6 illustrates an air vent assembly 100 where the louvers 102 and spacers 110 are not be provided with the tooling openings 120 and 128 illustrated in FIG. 5. In this case, the air vent 100 may be assembled using other assembly techniques known in the art. For example, FIG. 7 illustrates a pair of spacer magazines 170 that are used to align the spacers 110 over the louvers 102, and the louvers 102 and spacers 110 are affixed together using some type of adhesive or other fixative as is known in the art. Alternatively, the air vent assembly 100 may be assembled in a device magazine 180 as illustrated in FIG. 8, where the louvers 102 and spacers 110 are either not provided with tooling openings 120 and 128 or where the air vent 100 is assembled without taking advantage of the tooling openings 120 and 128, and the louvers 102 and spacers 110 are affixed together using some type of bonding agent or other fixative as is known in the art.

Figure 9:
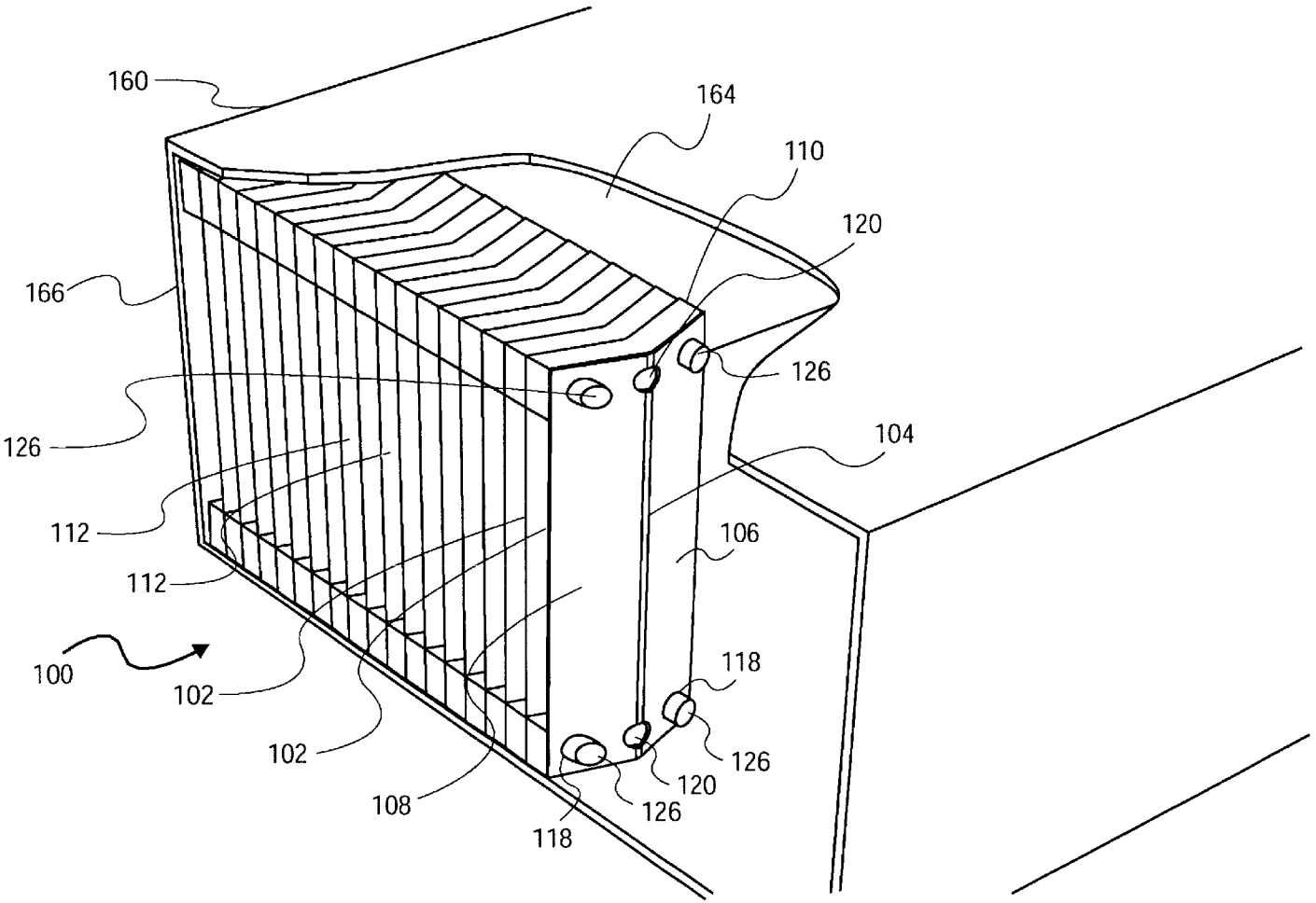
FIG. 9 illustrates a three-quarter perspective view of the air vent assembly illustrated in FIG. 1, mounted in a device housing in accordance with one embodiment of the present invention.
Figure 10:
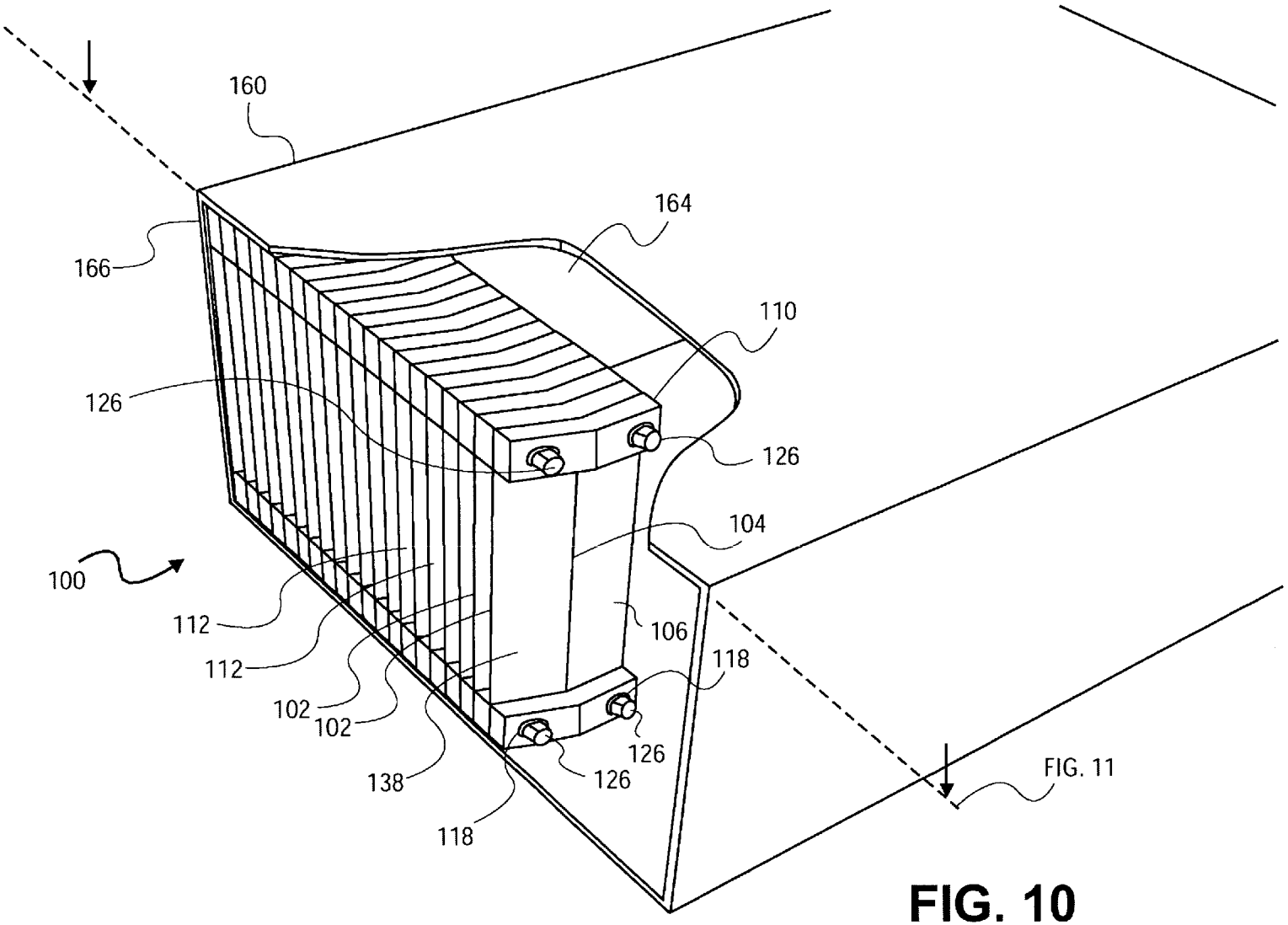
FIG. 10 illustrates a three-quarter perspective view of the air vent assembly illustrated in FIG. 1, mounted in a device housing in accordance with one embodiment of the present invention.
Figure 11:
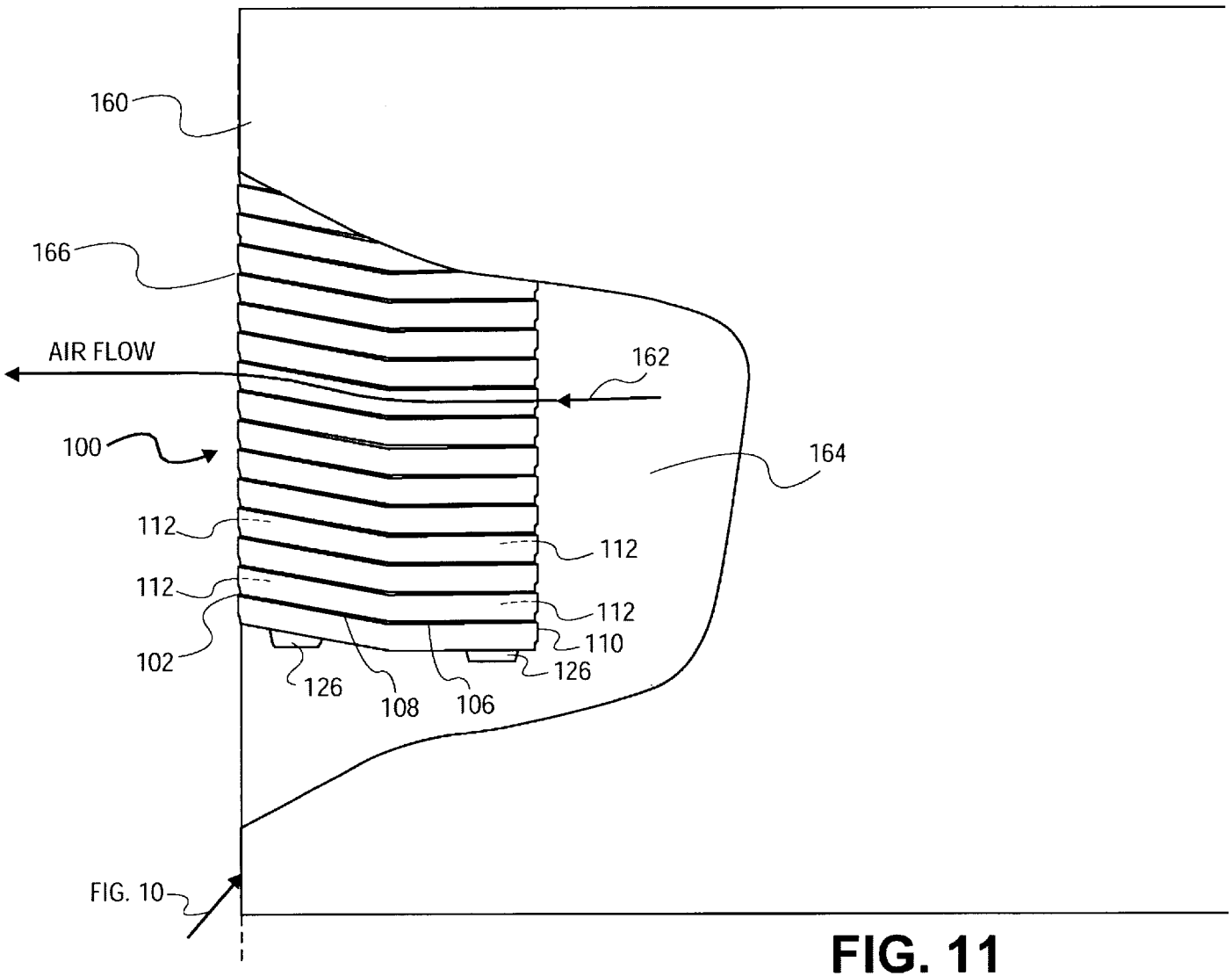
FIG. 11 illustrates a top perspective view of the air vent assembly mounted in a device housing as illustrated in FIG. 10, and in accordance with one embodiment of the present invention.

FIGS. 9–11 illustrate an air vent assembly 100 that is mounted in a device housing 160 that encases the device for which the air vent 100 is assembled. In one embodiment, illustrated in FIG. 9, the air vent 100 is mounted symmetrically in one side of the device housing 160 which is cut away to show that the inside vanes 106 extend obliquely toward the interior 164 of the device housing 160 in the same way that the outside vanes 108 extend obliquely toward the exterior 166 of the device housing 160. In an alternate embodiment, illustrated in FIG. 10, the air vent 100 is mounted asymmetrically in one side of the device housing 160 which is cut away to show that the inside vanes 106 extend perpendicularly toward the interior 164 of the device housing 160 while the outside vanes 108 extend obliquely toward the exterior 166 of the device housing 160. FIG. 11 illustrates a top view of the asymmetric mounting of the air vent 100 that is shown in FIG. 10 to show in further detail the perpendicular orientation of the inside vanes 106 and the oblique orientation of the outside vanes 108 in relation to the device housing 160. In the illustrated embodiment, the perpendicular orientation of the inside vanes 106 shown in FIGS. 10–11 allows the air to flow into the parallel sets of angled channels 112 formed by the louvers 102 and interlocking spacers 110 such that the direction of the air flow 162 is substantially parallel through that portion of the channel 112 facing the interior 164 of the device housing 160.

Figure 12:
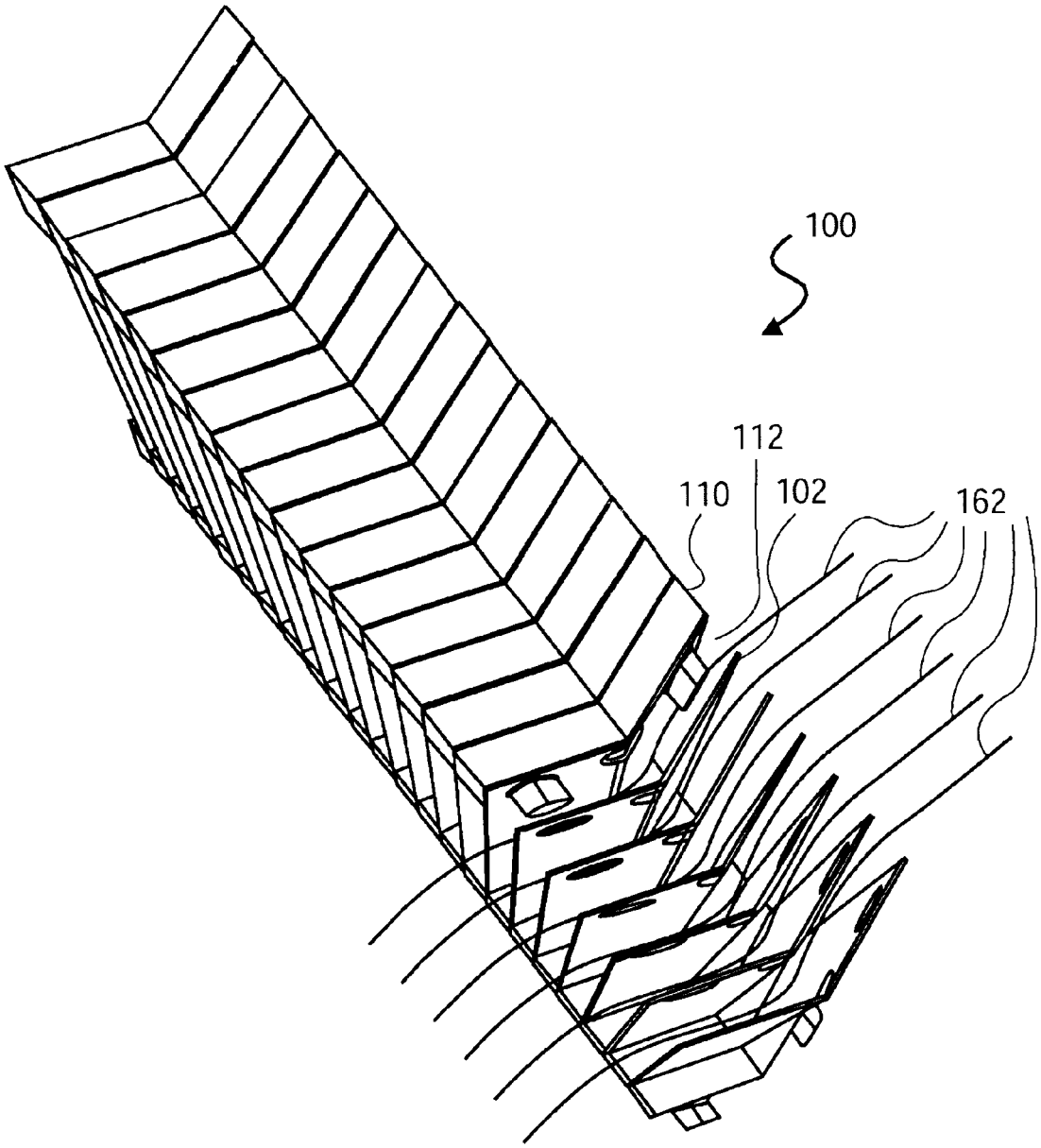
FIG. 12 illustrates a top perspective view of the air vent assembly illustrated in FIG. 1, with several spacers removed to reveal the flow of air through the air vent in accordance with one embodiment of the present invention.

FIG. 12 illustrates a top perspective view of the air vent assembly 100 illustrated in FIG. 1, with several spacers 110 removed to reveal the flow of air 162 through the parallel sets of angled channels 112 formed by the louvers 102 and spacers 110 of the air vent assembly 100 in accordance with one embodiment of the invention. As shown, the flow of air 162 through the parallel sets of angled channels 112 is relatively unobstructed to allow the maximum possible air flow while at the same time restricting the escape of light from the interior of the device.

Figure 13:
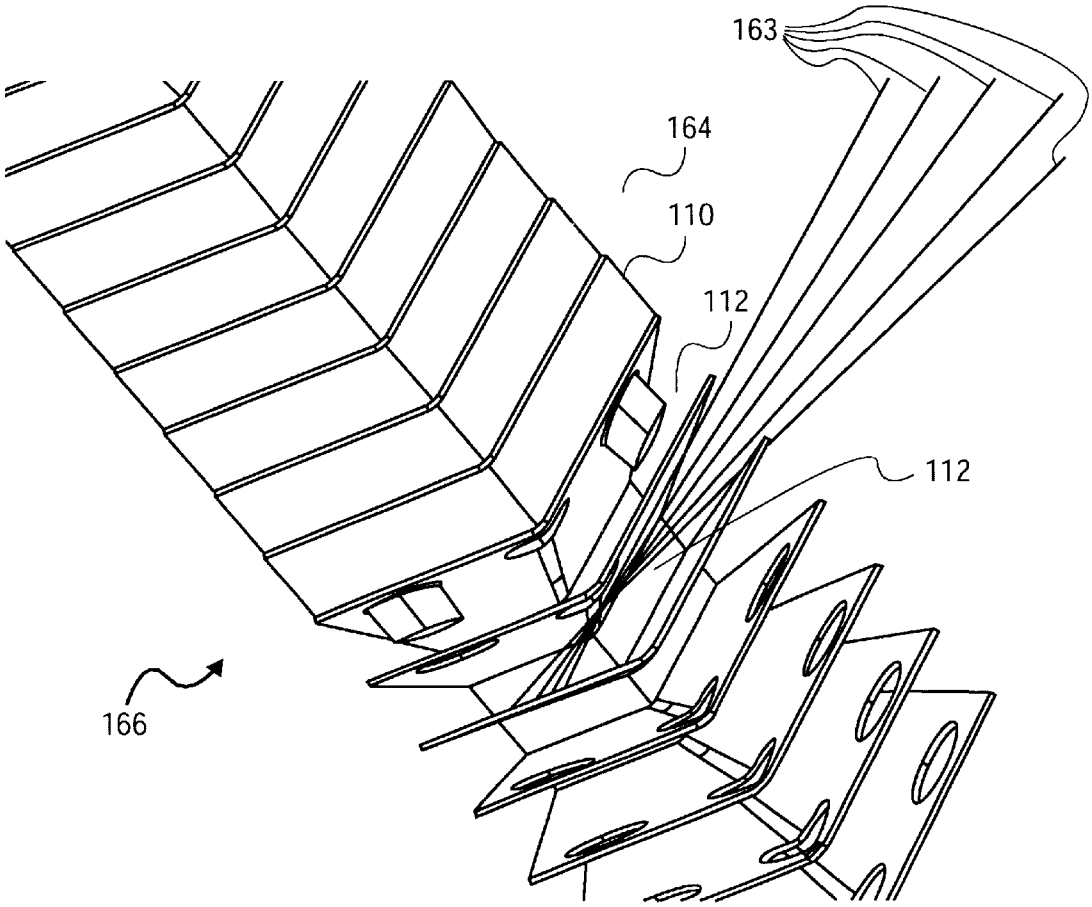
FIG. 13 illustrates a top perspective view of the air vent assembly illustrated in FIG. 1, with several spacers removed to reveal the blockage of light through the air vent in accordance with one embodiment of the present invention.

FIG. 13 illustrates a top perspective view of the air vent assembly 100 illustrated in FIG. 1, with several spacers 110 removed to reveal the path of light 163 through the parallel sets of angled channels 112 formed by the louvers 102 and spacers 110 of the air vent assembly 100 in accordance with one embodiment of the invention. As shown, the path of light 163 through the parallel sets of angled channels 112 is obstructed such that the escape of light from the interior 164 of the device within which the air vent 100 is mounted is substantially restricted or blocked from exiting to the exterior 166 of the device.

With reference to FIGS. 1–4, depending on the specific requirements of the device for which the air vent 100 is designed, variations in the angles 114 and 116 of the louvers 102 and spacers 110, the lengths of the vanes 106/142 and 108/144 of the louvers 102 and spacers 110, as well as the depth 130 of the spacer 110 may be employed without departing from the principles of the invention. For example, the vanes 106/142 and 108/144 of the louvers 102 and spacers 110 may have a certain width 132 on one side of the vent, and another width 136 on another side of the vent. Although the spacing between the louvers 102 dictated by the depth 130 of the spacers 102, also referred to as the pitch of the louvers 102, is typically constant within a given air vent assembly 100, gradations in the pitch may also be accommodated by changing the depth 130 of the spacers 110, with corresponding gradations in the width 132/136 and angles 114/116 of the vanes 106/142 and 108/144 of the louvers 102 and spacers 110, without departing from the principles of the invention. For example, although the illustrated embodiment shows the vanes 106/142 and 108/144 having a substantially equal length, vanes 106/142 and 108/144 of unequal length may be just as readily employed without departing from the principles of the invention.

Accordingly, a novel method and apparatus is described for assembling an air vent 100 for a device that blocks all or nearly all direct light emitted from a light source within the device while substantially minimizing the restriction of air flow through the air vent. From the foregoing description, those skilled in the art will recognize that many other variations of the present invention are possible. Thus, the present invention is not limited by the details described. Instead, the present invention can be practiced with modifications and alterations within the spirit and scope of the appended claims.

What is claimed is:

1. A method comprising:

connecting a first louver to a second louver with a first set of spacers, the louvers having a length and a width and the spacers having a chevron shape and an interlocking mechanism, by interlocking the first louver along the width to a top side of each one of the set of spacers with the interlocking mechanism, and interlocking the second louver along the width to a bottom side of each one of the set of spacers, so that the spacers separate the louvers and the louvers conform to the chevron shape of the spacers along their length to form a chevron shaped channel through which a minimally restricted flow of air is permitted and a ray of light is blocked;

connecting the second louver to a third louver with a second set of spacers to form a second chevron shaped channel adjacent to the first chevron shaped channel, in the same manner as connecting the first louver to the second louver, interlocking the second set of spacers with the first set of spacers with the interlocking mechanism, wherein the interlocking mechanism comprises at least one post on the top side of the spacers and a corresponding hole on the bottom side of the spacers so that the post of the first spacer fits snugly into the hole of the second spacer, until a desired number of adjacent chevron shaped channels are formed to create an air vent; and mounting the air vent into a device housing.

2. The method of claim 1, wherein the louvers has at least one opening corresponding to the at least one post on the top side of the spacers, and wherein interlocking the louvers to the spacers further comprises anchoring the opening over the corresponding post.

3. A method comprising:

connecting a first louver to a second louver with a first set of spacers, the louvers having a length and a width and the spacers having a chevron shape and an interlocking mechanism, wherein the interlocking mechanism comprises a tab on the top side of the spacer and a corresponding slot on the bottom side of the spacer, by interlocking the first louver along the width to a top side of each one of the set of spacers with the interlocking mechanism, and interlocking the second louver along the width to a bottom side of each one of the set of spacers, so that the spacers separate the louvers and the louvers conform to the chevron shape of the spacers along their length to form a chevron shaped channel through which a minimally restricted flow of air is permitted and a ray of light is blocked;

connecting the second louver to a third louver with a second set of spacers to form a second chevron shaped channel adjacent to the first chevron shaped channel, in the same manner as connecting the first louver to the second louver, interlocking the second set of spacers with the first set of spacers with the interlocking mechanism, until a desired number of adjacent chevron shaped channels are formed to create an air vent; and mounting the air vent into a device housing.

4. The method of claim 1 or claim 3, further comprising aligning the louvers and the spacers to facilitate the connecting of the louvers with the spacers using an assembly mechanism, the assembly mechanism comprising a magazine.

5. The method of claim 4, wherein the magazine is a spacer magazine.

6. The method of claim 4, wherein the magazine is a device magazine.

7. The method of claim 4, wherein the assembly mechanism comprises a tooling rod and the louvers and spacers each have a tooling opening, and wherein aligning comprises threading the tooling rod through the tooling openings.

8. The method of claim 1 or claim 3, wherein the louvers are constructed of a thin thermoplastic material capable of conforming to the chevron shape of the spacers.

9. The method of claim 1 or claim 3, wherein the louvers are constructed of a sheet metal that is capable of conforming to the chevron shape of the spacers.

10. An air vent assembly comprising:

a first louver connected to a second louver with a first set of spacers, the louvers having a length and a width and the spacers having a chevron shape and an interlocking mechanism, wherein the interlocking mechanism comprises at least one post on the top side of the spacers and a corresponding hole on the bottom side of the spacers so that the post of the first spacer fits snugly into the hole of the second spacer, the first louver affixed along the width to a top side of each one of the set of spacers, and the second louver affixed along the width to a bottom side of each one of the set of spacers, the spacers separating the louvers and the louvers conforming to the chevron shape of the spacers along their length, forming a chevron shaped channel through which a minimally restricted flow of air is permitted and a ray of light is blocked;

a third louver connected to the second louver with a second set of spacers forming a second chevron shaped channel adjacent to the first chevron shaped channel, the adjacent chevron shaped channels forming an air vent, wherein each louver is interlocked with the spacers using the interlocking mechanism.

11. An air vent assembly comprising:

a first louver connected to a second louver with a first set of spacers, the louvers having a length and a width and the spacers having a chevron shape and an interlocking mechanism, wherein the louvers has at least one opening corresponding to the at least one post on the top side of the spacers, and wherein affixing the louvers to the spacers further comprises anchoring the opening over the corresponding post, the first louver affixed along the width to a top side of each one of the set of spacers, and the second louver affixed along the width to a bottom side of each one of the set of spacers, the spacers separating the louvers and the louvers conforming to the chevron shape of the spacers along their length, forming a chevron shaped channel through which a minimally restricted flow of air is permitted and a ray of light is blocked;

a third louver connected to the second louver with a second set of spacers forming a second chevron shaped channel adjacent to the first chevron shaped channel, the adjacent chevron shaped channels forming an air vent, wherein each louver is interlocked with the spacers using the interlocking mechanism.

12. The air vent assembly of claim 10 or claim 11, wherein the interlocking mechanism comprises a tab on the top side of the spacer and a corresponding slot on the bottom side of the spacer.

13. The air vent assembly of claim 10 or claim 11, wherein the louvers and the spacers are aligned with an assembly mechanism before being connected.

14. The air vent assembly of claim 13, wherein the assembly mechanism is a spacer magazine.

15. The air vent assembly of claim 13, wherein the assembly mechanism is a device magazine.

16. The air vent assembly of claim 13, wherein the assembly mechanism is a tooling rod and the louvers and spacers each have a tooling opening, and aligned comprises the tooling rod having been threaded through the tooling openings.

17. The air vent assembly of claim 10 or claim 11, wherein the louvers are constructed of a thin thermoplastic material capable of conforming to the chevron shape of the spacers.

18. The air vent assembly of claim 10 or claim 11, wherein the louvers are constructed of a sheet metal that is capable of conforming to the chevron shape of the spacers.

19. An apparatus comprising:

means for connecting a first louver to a second louver with a first set of spacers, the louvers having a length and a width and the spacers having a chevron shape, including a means for interlocking the first louver along the width to a top side of each one of the set of spacers, wherein the means for interlocking the first and second louvers with the spacers comprises at least one post on the top side of the spacers and a corresponding hole on the bottom side of the spacers so that the post of the first spacer fits snugly into the hole of the second spacer, and a means for interlocking the second louver along the width to a bottom side of each one of the set of spacers, so that the spacers interlock with and separate the louvers and the louvers conform to the chevron shape of the spacers along their length to form a chevron shaped channel through which a minimally restricted flow of air is permitted and a ray of light is blocked;

means for connecting the second louver to a third louver with a second set of spacers to form a second chevron shaped channel adjacent to the first chevron shaped channel in the same manner as the means for connecting the first louver to the second louver, until a desired number of adjacent chevron shaped channels are formed to create an air vent; and means for mounting the air vent into a device housing.

20. The method of claim 19, wherein the louvers has at least one opening corresponding to the at least one post on the top side of the spacers, and wherein the means for affixing the louvers to the spacers further comprises means for anchoring the opening over the corresponding post.

21. An apparatus comprising:

means for connecting a first louver to a second louver with a first set of spacers, the louvers having a length and a width and the spacers having a chevron shape, including a means for interlocking the first louver along the width to a top side of each one of the set of spacers, wherein the means for interlocking comprises a tab on the top side of the spacer and a corresponding slot on the bottom side of the spacer, and a means for interlocking the second louver along the width to a bottom side of each one of the set of spacers, so that the spacers interlock with and separate the louvers and the louvers conform to the chevron shape of the spacers along their length to form a chevron shaped channel through which a minimally restricted flow of air is permitted and a ray of light is blocked;

means for connecting the second louver to a third louver with a second set of spacers to form a second chevron shaped channel adjacent to the first chevron shaped channel in the same manner as the means for connecting the first louver to the second louver, until a desired number of adjacent chevron shaped channels are formed to create an air vent; and means for mounting the air vent into a device housing.

22. The apparatus of claim 19 or claim 21, further comprising a means for aligning the louvers and the spacers to facilitate the connecting of the louvers with the spacers using an assembly mechanism, the assembly mechanism comprising a magazine.

23. The apparatus of claim 22, wherein the magazine is a spacer magazine.

24. The apparatus of claim 22, wherein the magazine is a device magazine.

25. The apparatus of claim 22, wherein the assembly mechanism comprises a tooling rod and the louvers and spacers each have a tooling opening, and wherein the means for aligning comprises threading the tooling rod through the tooling openings.

26. The apparatus of claim 19 or claim 21, wherein the louvers are constructed of a thin thermoplastic material capable of conforming to the chevron shape of the spacers.

27. The apparatus of claim 19 or claim 21, wherein the louvers are constructed of a sheet metal that is capable of conforming to the chevron shape of the spacers.

* * * * *